US009885511B2

(12) United States Patent
Brunner et al.

(10) Patent No.: US 9,885,511 B2
(45) **Date of Patent: *Feb. 6, 2018**

(54) DISPENSER DEVICE FOR ICE AND WATER, COMPONENTS THEREOF AND PROCESS OF CLEANING SAME

(71) Applicants: Roger P. Brunner, Wind Gap, PA (US); Steven R. Follett, Bethlehem, PA (US); Matthew S. Greene, Northampton, PA (US); Robert Hettinger, Philadelphia, PA (US); Michael A. Rice, Bethlehem, PA (US); Michael S. Yautz, Easton, PA (US)

(72) Inventors: Roger P. Brunner, Wind Gap, PA (US); Steven R. Follett, Bethlehem, PA (US); Matthew S. Greene, Northampton, PA (US); Robert Hettinger, Philadelphia, PA (US); Michael A. Rice, Bethlehem, PA (US); Michael S. Yautz, Easton, PA (US)

(73) Assignee: Follett Corporation, Easton, PA (US)

( * ) Notice: Subject to any disclaimer, the term of this patent is extended or adjusted under 35 U.S.C. 154(b) by 732 days.

This patent is subject to a terminal disclaimer.

(21) Appl. No.: 14/195,993

(22) Filed: Mar. 4, 2014

(65) Prior Publication Data

US 2014/0182323 A1 Jul. 3, 2014

Related U.S. Application Data

(63) Continuation of application No. 12/544,565, filed on Aug. 20, 2009, now Pat. No. 8,756,950.

(51) Int. Cl.
*F25C 5/18* (2006.01)
*F25C 1/14* (2006.01)
(Continued)

(52) U.S. Cl.
CPC ..... *F25C 5/182* (2013.01); *F25C 1/147* (2013.01); *F25C 5/002* (2013.01); *F25C 5/18* (2013.01);
(Continued)

(58) Field of Classification Search
CPC .. F25C 5/182; F25C 5/18; F25C 1/147; F25C 5/002; F25C 2400/14; F25C 2700/04;
(Continued)

(56) References Cited

U.S. PATENT DOCUMENTS 2,747,375 A 5/1956 Pichler
2,779,165 A * 1/1957 Pichler ..... F25C 5/00 141/105
(Continued)

FOREIGN PATENT DOCUMENTS

JP 03260574 11/1991
JP 200222325 1/2002
(Continued)

*Primary Examiner* — Emmanuel Duke
(74) *Attorney, Agent, or Firm* — Paul & Paul

(57) ABSTRACT

A low profile ice maker/dispenser and water dispenser having a high ice making capacity, for ice nugget manufacture is provided, wherein ice nuggets are metered out of a storage bin via a nugget dispenser outlet, and whereby water is dispensed via a water dispenser outlet. A refrigeration cycle is used, wherein an auger compresses ice on a wall of an evaporator and delivers the ice to the ice bin, breaking it into nuggets along the way. An outer wall of the evaporator is comprised of part of the water reservoir. A baffle in the ice bin facilitates metering of the amount of ice discharged. The system comprises a closed system that enables efficient cleaning of the system.

12 Claims, 10 Drawing Sheets

(51) Int. Cl.
*F25C 5/00* (2006.01)
*F25D 23/12* (2006.01)

(52) U.S. Cl.
CPC ..... *F25D 23/126* (2013.01); *F25C 2400/12* (2013.01); *F25C 2400/14* (2013.01); *F25C 2700/04* (2013.01); *F25D 2317/0417* (2013.01); *F25D 2323/121* (2013.01); *F25D 2500/02* (2013.01); *Y10T 137/7358* (2015.04)

(58) Field of Classification Search
CPC ..... F25C 2400/12; F25D 23/126; F25D 2323/121; F25D 2500/02; F25D 2317/0417; Y10T 137/7358
See application file for complete search history.

(56) References Cited

U.S. PATENT DOCUMENTS 3,080,884 A 3/1963 Nelson et al.
3,341,065 A 9/1967 Schuldt et al.
3,771,560 A 11/1973 Conti et al.
4,123,918 A * 11/1978 Kohl ..... F25C 5/007 222/146.6
4,248,276 A 2/1981 Gosnell
4,796,441 A 1/1989 Goldstein
4,916,910 A * 4/1990 Schroeder ..... B67D 1/0864 62/390
5,112,477 A 5/1992 Hamlin
5,125,242 A * 6/1992 von Blanquet ..... F25C 5/007 198/453
D333,405 S 2/1993 Moyer, Jr. et al.
5,211,030 A 5/1993 Jameson
5,394,708 A 3/1995 Whinery et al.
5,542,573 A 8/1996 Frantz
5,797,514 A 8/1998 Twiggar et al.
5,887,758 A 3/1999 Hawkes et al.
5,950,866 A 9/1999 Lancaster
5,987,900 A * 11/1999 Love ..... B67D 1/0857 62/348
6,134,908 A 10/2000 Brunner et al.
6,321,802 B1 * 11/2001 Weeks ..... F25C 5/007 141/351
6,561,691 B1 * 5/2003 McCann ..... F25C 5/007 366/299
6,685,053 B2 2/2004 Hawkes et al.
6,860,408 B2 3/2005 Hawkes
6,952,935 B2 10/2005 Vorosmarti et al.
7,096,686 B2 8/2006 Brunner et al.
7,137,271 B2 11/2006 Hawkes et al.
7,263,844 B2 9/2007 Brunner et al.
7,322,201 B2 1/2008 Brunner et al.
7,426,838 B1 9/2008 Shapiro et al.
7,469,548 B2 12/2008 Brunner et al.
7,469,552 B2 12/2008 Brunner et al.
2001/0027654 A1 10/2001 Shapiro et al.
2004/0079103 A1 * 4/2004 Hawkes ..... G07F 11/66 62/340
2005/0103039 A1 * 5/2005 Vorosmarti ..... F25C 5/002 62/344
2006/0277928 A1 * 12/2006 McDougal ..... F25C 5/187 62/66
2006/0277937 A1 * 12/2006 Schlosser ..... F25C 1/147 62/344
2008/0011000 A1 * 1/2008 Brunner ..... F25C 1/147 62/68
2008/0022711 A1 * 1/2008 Brunner ..... F25C 1/145 62/354
2008/0196422 A1 * 8/2008 Lee ..... B67D 1/0857 62/129
2012/0186276 A1 * 7/2012 Seymour ..... F25C 5/002 62/66

FOREIGN PATENT DOCUMENTS

JP 2006242453 9/2006
JP 2006242453 A * 9/2006
JP 2006308129 11/2006

* cited by examiner

D2

DISPENSER DEVICE FOR ICE AND WATER, COMPONENTS THEREOF AND PROCESS OF CLEANING SAME

CROSS-REFERENCE TO RELATED APPLICATIONS

This application is a continuation of U.S. Ser. No. 12/544,565, filed Aug. 20, 2009.

THE PRESENT INVENTION

The present invention is a low profile ice maker/dispenser and water dispenser that has a high ice making capacity, particularly for nugget type ice manufacture, wherein the dispensing of ice nuggets is metered and which limits ice size prior to ice reaching the dispenser discharge outlet or spout in a thin stream of ice, for dispensing of the ice nuggets into a cup or other container in which it is to be received, rather than being dispensed in an array that could fall outside the cup or other container.

The ice is formed in a refrigeration cycle, and uses an evaporator as part of that cycle. A jacket for the evaporator comprises a novel jacket of reinforced thermoset plastic material that preferably is part of a water reservoir and the jacket is sufficiently dense and free of pores of a sufficient size that pressurized refrigerant gas cannot pass through it, so that the jacket contains the pressurized refrigerant gas. Additionally, the material of construction of the jacket does not change significantly, dimensionally, in use.

In the device of this invention, ice nuggets are delivered into a storage bin via an ice nugget delivery conduit from an ice maker.

In order to handle melt water from the ice storage bin, a drain line exists between the ice storage bin and a water reservoir which feeds the ice maker. A vent line also exists between the ice storage bin and water reservoir, with the storage bin, ice maker, ice nugget delivery conduit, water drain line and vent line comprising a closed system, whereby bin melt water can be recycled into ice nuggets.

The ice nugget delivery conduit has an internal diameter that is substantially close to, or just slightly greater than the diameter of the ice nuggets, and the ice nugget delivery conduit enters the ice bin from the side thereof near the upper end of the ice bin, and through an arcuate portion of the conduit, such that ice traversing the arcuate portion is broken up into individual ice nuggets.

The ice maker/dispenser, being a closed system between the water reservoir that feeds the ice maker, the ice maker itself, the storage bin, the ice nugget delivery conduit, the bin drain line and the vent line, enables a cleaning procedure by which a cleaning and/or sanitizing solution may be introduced into the closed system for cleaning and/or sanitizing, held therein for a predetermined period of time, and then drained therefrom, without requiring disassembly and manual cleaning of the various components.

BACKGROUND OF THE INVENTION

Ice makers/dispensers are commercially available for home and office use.

Typically, residential refrigerators include ice making/dispensing features. These are capable of making small amounts of ice over a period of time, with limited storage capability. Such refrigerators are not adaptable for a larger office having greater ice production needs and greater storage needs.

Particularly, in an office environment, the size constraints limit the adaptability of refrigerator systems as they are conventionally known to satisfy office and commercial needs.

Additionally, typical ice dispensers are not also adapted to dispense water, especially in units that are of sufficiently small size to meet the size constraints of an office or commercial establishment while still producing a desirable amount of production of ice.

Additionally, where ice is to be dispensed from storage bins, it has been known to use augers in storage bins. However, augers that deliver ice to the discharge from the storage bins can surge in flow, resulting in overfilling of the user's cup or other container, often discharging excessive amounts of ice into the cup, or in an array around the cup, possibly landing on a drip tray and melting, leaving water around the vicinity of the ice maker.

In ice making systems in accordance with the prior art, it is known to use evaporators for making ice, including evaporators with inner and outer cylinders between which the refrigerant flows. Such systems are available for example, as are set forth in U.S. Pat. No. 7,322,201, the complete disclosure of which is herein incorporated by reference.

Additionally, conventional ice makers/dispensers typically require an open drain, to allow for removal of melt water from their ice storage bin, and to allow mineral laden water to be periodically drained from the evaporator portion of the ice making system, both of which can require interruption of the ice maker/dispenser use, to manually clean the components that comprise the system.

SUMMARY OF INVENTION

The present invention is directed to providing a low profile ice and water dispenser device for home and/or office use, capable of fitting in a vertical opening on top of a countertop and beneath a typically spaced overhanging cabinet, wherein the ice maker/dispenser is efficiently constructed to be of a limited necessary height.

OBJECTS

It is an object to provide the above invention, wherein the device utilizes a cylindrical freezing chamber and rotatable auger.

It is a further object of this invention wherein ice is delivered from the ice maker into an ice storage bin it enters the storage bin from the side, thereby avoiding adding additional height to the unit such as would be necessary if the conduit delivered ice into the bin from above.

It is yet another object of this invention to provide an ice storage bin having a melt water delivery line between the storage bin and a water reservoir that feeds the ice maker, that is gravity-flow operated.

It is a further object of this invention to accomplish the above objects, wherein a tray is provided for receiving a cup or other container, for receiving ice and/or water, and wherein the operation of the unit will be discontinued when water build-up in the tray reaches a predetermined level.

It is yet another object of this invention to accomplish the delivery of ice from a lower end of an ice nugget bin to an upper end thereof, by means of an auger, and wherein an ice baffle is provided at the upper end of the ice bin, near the ice nugget discharge outlet which meters the ice, to prevent to high a rate of flow of ice through the outlet, and which severs ice nuggets of too great a size and allows ice nuggets of a predetermined desired size to pass from the bin via the ice nugget discharge outlet.

It is a further object of this invention to accomplish the above object, wherein the conduit that carries ice nuggets from the ice maker to the bin is configured to break up ice nuggets to a desired size prior to their entering the bin.

It is a further object of this invention to provide an apparatus for making and containing ice nuggets and delivering them to a bin, wherein a water drain line between the ice nugget bin and a water reservoir that provides water for the ice maker recirculates the melt water back into the water reservoir.

It is a further object of this invention to accomplish the above objects wherein the ice nugget bin, water reservoir, water drain line, ice nugget delivery conduit and vent line are part of a closed system that, except for the ice dispenser outlet, is sealed closed to atmosphere until it is desired to add additional water to the water reservoir when the water level in the reservoir becomes low.

It is yet another object of this invention to provide a refrigeration system for making ice nuggets, wherein a refrigeration cycle is employed, having an evaporator jacket that is comprised of a plastic material that prevents passage of gaseous refrigeration fluid from the evaporator, through the wall of the jacket.

It is another object of this invention to provide a method of cleaning an ice maker/dispenser device in which the components of the system that contain ice and/or water are substantially closed against atmosphere and can be cleaned by introducing a cleaning and/or sanitizing solution into the otherwise closed system once the ice dispenser outlet is closed off for a predetermined period of time prior to draining the solution therefrom.

Other objects and advantages of the present invention will be readily apparent upon a reading of the following brief descriptions of the drawing figures, the detailed descriptions of the preferred embodiments, and the appended claims.

BRIEF DESCRIPTIONS OF THE DRAWING FIGURES

DETAILED DESCRIPTIONS OF THE PREFERRED EMBODIMENTS

Figure 1:
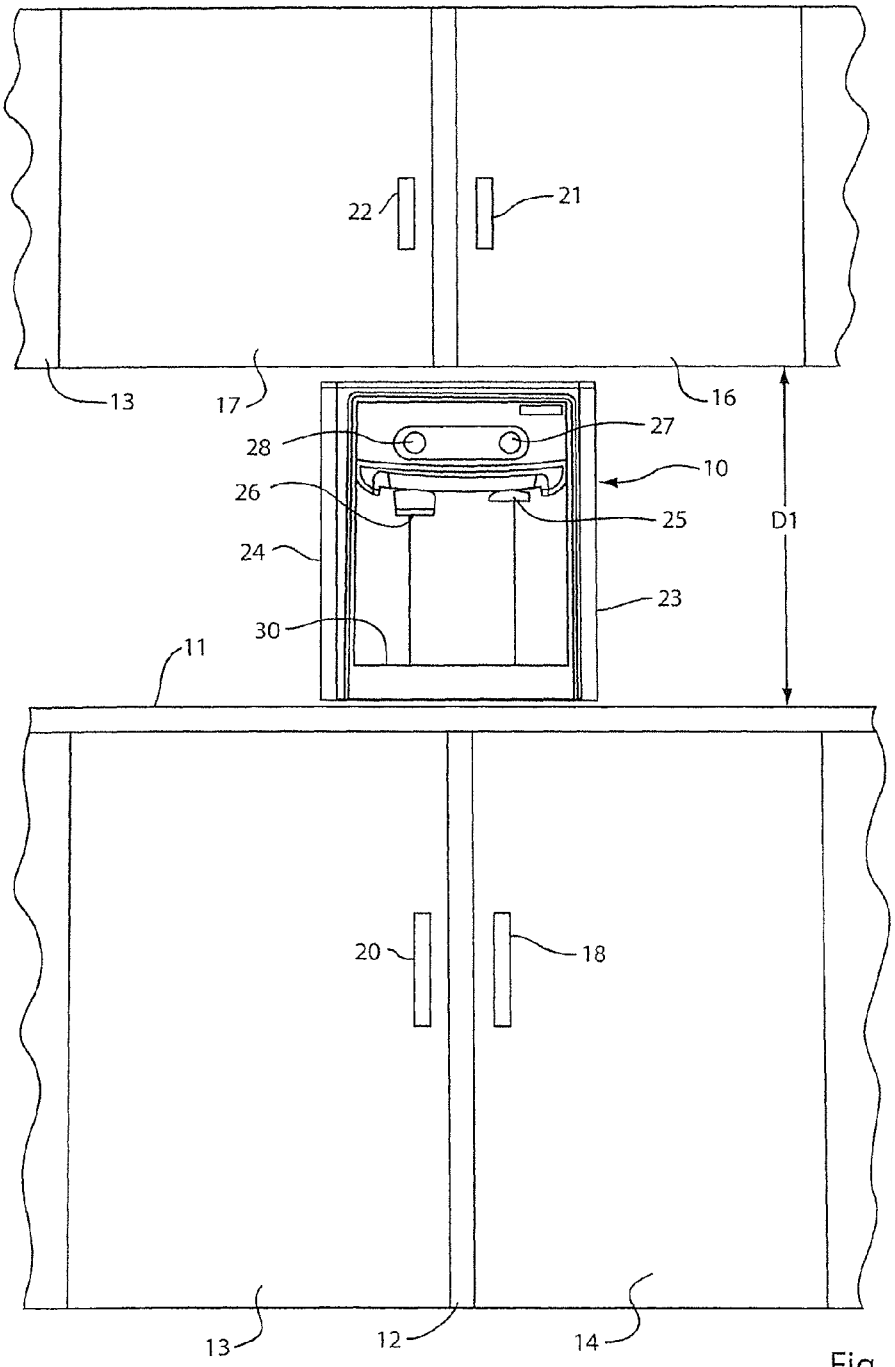
FIG. 1 is a front elevational view of a combination ice and water dispenser device in accordance with this invention, illustrated disposed on top of a countertop and beneath an overhanging cabinet, both countertop and cabinet of which are fragmentally illustrated.

Referring now to FIG. 1, the low profile ice maker/dispenser and water dispenser of this invention is generally designated by the numeral 10, disposed on a countertop 11 that, in turn, is provided with, and supported by a lower cabinet 12, above which is generally disposed an upper cabinet 13. The lower and upper cabinets may be provided with doors 14, 15, 16 and 17, as shown that, in turn, may carry handles 18, 20, 21 and 22 for opening the doors, as may be desired. The doors may be hingedly mounted on the cabinet structures 12, 13.

The dispenser device 10 is shown to have a sufficiently low profile that it is preferably no more than 18 inches in height, to fit between the countertop 11 and the upper cabinet 13, within a distance D1, as shown, which distance D1 may be between 18 and 20 inches.

The dispenser device 10 of this invention is adapted to provide sufficient ice making and ice storage capacity for an office setting, or a high end residential market. For example, a 50 person office can be served successfully by an ice maker/dispenser that produces more than 4 and preferably about 4 to 5 pounds of ice per hour, and storing greater than 7 and preferably 7 to 8 pounds of ice in its internal storage bin.

Additionally, the dispenser device should be able to accommodate cups or other containers that are about 8 inches or more high, such that discharge outlets for ice and water must be at a sufficient height to accommodate such cups or containers therebeneath.

Additionally, it is desirable that the dispenser device not be excessively wide, to accommodate most office situations. To this end, the dispenser device 10, between its right and left sides 23, 24, should be about 15 inches in width.

In the dispenser device 10 as illustrated in FIG. 1, the water discharge outlet is illustrated at 25, and the ice discharge outlet is illustrated at 26. Respective actuators 27, 28 are illustrated, for being contacted by the hand of a user, for actuating the discharge of water and ice, via water and ice outlets 25, 26.

A tray 30 is illustrated at the lower end of the dispenser device 10, for accommodating a cup or other container thereon, with the tray being adapted to receive and hold overflow water and/or ice therein.

Figure 2:
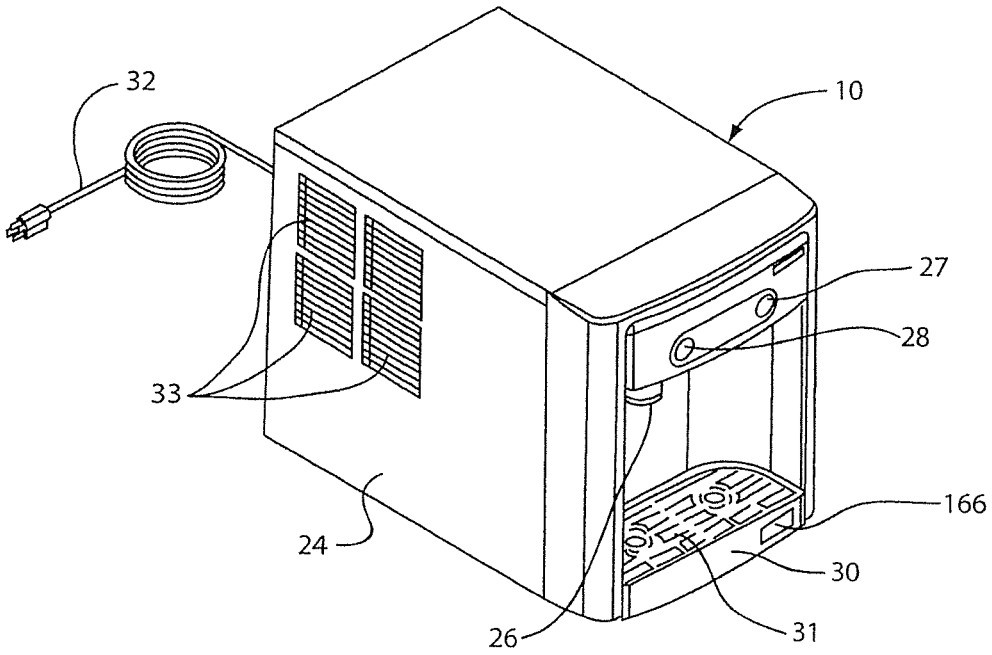
FIG. 2 is a top, front and left side perspective view of the ice and water dispenser device in accordance with this invention.

With reference to FIG. 2, it will be seen that the tray 30 is provided with a perforate grate 31 at its upper end, upon which a cup or other container would be placed to receive water and/or ice dispensed therein. The dispenser 10 in FIG. 2 is illustrated as having an electrical connection 32 for connection to an electrical outlet for supplying power to the dispenser device 10. Vents 33 are illustrated in the left wall 24 of the dispenser device 10, for accommodating the dissipation of heat generated by a refrigeration cycle that exists inside the dispenser device 10, especially from a condenser unit contained therein.

Figure 3:
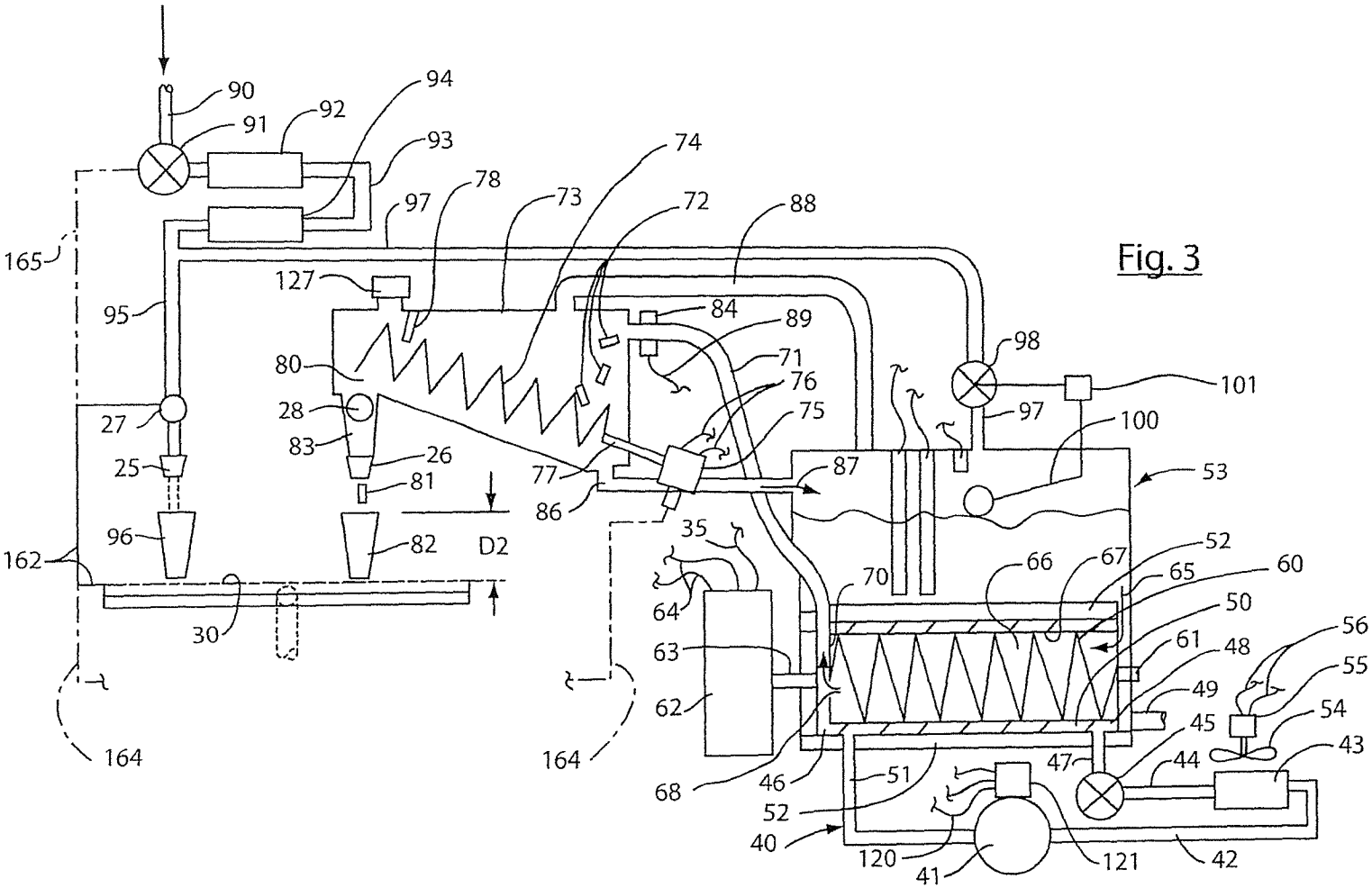
FIG. 3 is a schematic view of the various components of the refrigeration system for making ice nuggets and delivering the same to a storage bin for dispensing into a cup or other container disposed on a drip tray, and for supplying water also to a cup disposed on a drip tray, which schematic also shows various details and control embodiments of the present invention.

With reference now to FIG. 3, the functional characteristics of the ice and water dispenser device will now be discussed.

At the lower right portion of the schematic of FIG. 3, a refrigeration cycle is generally indicated at 40, as including a compressor 41, for compressing a refrigerant vapor, such as Freon or the like, which is delivered via a refrigerant line 42 to a condenser 43, where heat is dissipated from the condenser, and with the refrigerant fluid then passing via refrigerant line 44 to and through an expansion device 45, where it is changed into a gaseous state for delivery to an evaporator 46 via a refrigerant line 47. The evaporator 46 has an inner cylindrical wall 48 that comprises the evaporator body, along with a generally spiral flight 50 carried by the metal, preferably steel evaporator body 48, on the outer diameter of the evaporator body 48, with the spiral flight creating a canal along which the refrigerant flows from the refrigerant inlet line 47 to the refrigerant vapor line 51 at the outlet of the evaporator 46, for return of refrigerant vapor back to the compressor 41.

The cylindrical jacket 52 for the evaporator 46 is comprised of a preferably plastic material that will be discussed further herein, that is a component of a water reservoir 53 that will likewise be discussed in greater detail hereafter. At right and left ends of the evaporator 46, suitable sealing means are provided, such as O-rings (not shown), for sealing the refrigerant flowing in the canal provided by the helical flight, to prevent leakage of refrigerant fluid from the evaporator at right and left ends.

A suitable fan 54 will preferably be provided, motor driven at 55 from a suitable electrical source 56, for facilitating the dissipation of heat from the condenser 43.

An auger 60 is located inside the evaporator 46, being shaft mounted at 61 on its right end as shown in FIG. 3, and being driven by a gearmotor 62 at its left end as shown, for rotatingly driving the auger shaft 63. The gearmotor 62 is suitably driven by electric power from wires 64, as shown.

During rotation of the auger 60, water provided from the water reservoir 53, via an opening at the right end of the evaporator, as shown, enters the freezing zone 66, to form as ice on the wall 67 of the evaporator, to be scraped therefrom by the auger 60, and delivered leftward along the auger, to be compacted as an elongate cylinder of ice as ice leaves the left end 68 of the evaporator body in the direction of arrow 70 into an ice conduit 71 for delivery as individual ice nuggets 72 into an ice bin 73.

In the ice bin 73 a wire screw type auger 74 is disposed, at an acute angle, as illustrated, and is motor driven via a motor 75 suitably electrically connected at 76 for driving a shaft 77 that drives the wire auger 74.

Ice nuggets 72 that have accumulated at the lower end of the bin (not shown in FIG. 3) are thus delivered via the wire auger 72 from a lower end of the bin, to an upper end of the bin, where they are metered via an ice nugget baffle 78 that will later be discussed herein, to a location 80 from where they can be discharged through the ice nugget discharge outlet 26, upon a user actuating the discharge of ice nuggets therethrough via engagement with the actuator 28, whereby discharged ice nuggets 81 may fall into a cup or other container 82 therebeneath. It will be understood that the actuator 28 can, by any mechanical or electrical means (not shown) cause ice to flow through the discharge chute 83, for discharge of ice 81 through the outlet 26.

If desired, the flow of ice via line 71 into the bin 73 may be interrupted in the event that the bin 73 becomes full of ice, by having a suitable ice fill controller 84 disposed in the line 71, which can be electrically connected via line 120 to compressor 41 to shut down the compressor 41, and at 89 to the gearmotor 62 to discontinue operation of the gearmotor 62 that drives the ice scraping auger 60, until some of the ice nuggets 72 are emptied from the bin 73, in which case, the controller 84 can re-open the line 71 and re-actuate the gearmotor 62 and compressor 41, to resume filling the bin 73 with ice nuggets. The controller 84 can, if desired, operate to sense axial strain in the conduit 71 as is disclosed in U.S. Pat. No. 7,469,548, the complete disclosure of which is herein incorporated by reference.

In the event that ice nuggets in the bin 73 begin to melt, and melt water is present at the lower end of the bin 73, such melt water can drain by entering a water drain line 86, to pass into the water reservoir 53 via the drain line 86, by means of gravity flow thereto, in the direction of arrow 87.

A vent line 88 exists between the ice storage bin 73 and the water reservoir 53, as shown, in that, as will later be discussed herein, the ice storage bin 73, the water reservoir 53, the zone 66 for ice formation within the evaporator 46, the drain line 86, and the ice delivery conduit 71 comprise a closed system (except for the ice dispenser outlet 26), sealed closed to atmosphere, remaining clean and uncontaminated from ambient influences.

Water is delivered to the dispenser device 10 from a house or office water supply line 90, through a valve 91 that controls water flow, through an optional ultraviolet treatment station 92 where ultraviolet light can neutralize any bacteria in the water, with the water then passing via water line 93 to an optional filter 94, to a water delivery line 95, then to the water discharge outlet 25, controlled by the water discharge actuator 27, in much the same manner as has been discussed above with respect to the ice discharge actuator 28, for delivery of water to a cup or other container 96 disposed on the tray 30.

Inlet water is also thereby delivered via line 97 to the water reservoir 53, via a valve 98 that is controlled by means of a float 100 operated in accordance with the water level within the water reservoir 53, to allow more water to enter the reservoir 53 via control device 101 that opens and closes the valve 98.

In FIG. 3, it will be seen that the cups 82 and 96 are at a height D2, which is generally 8 inches, such that the ice and water outlets 26, 25 must be at a distance above the upper surface of the tray 30, that is greater than D2, to allow for discharge of ice nuggets 82 out of the ice nugget discharge outlet 26, into a cup 82, and to allow for discharge of water from the water discharge outlet 25, likewise into a cup 96.

Figure 4:
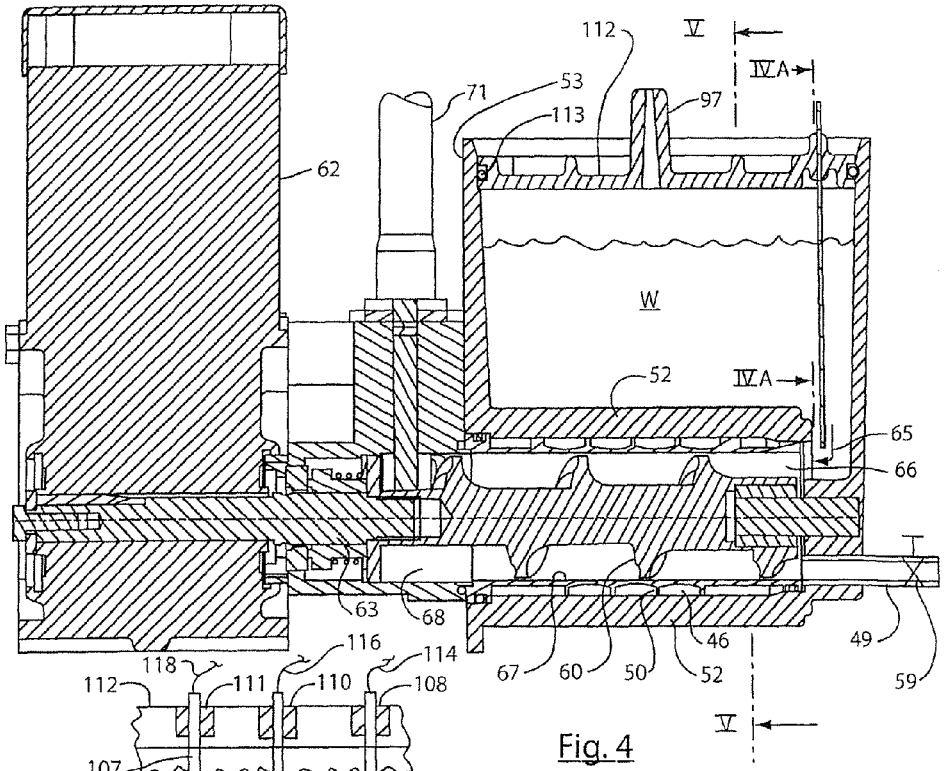
FIG. 4 is a vertical sectional view, through the ice maker, its water reservoir and gear motor drive, in accordance with this invention.
Figure 5:
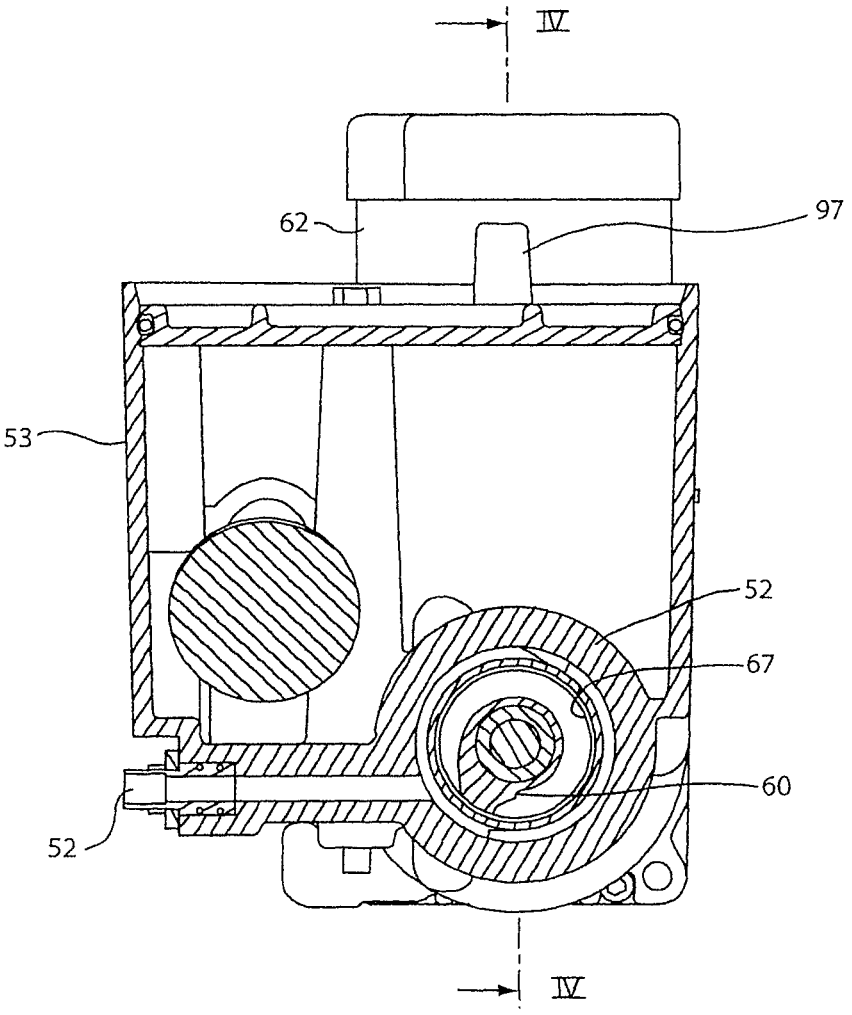
FIG. 5 is a transverse vertical sectional view taken through the water reservoir and ice maker of this invention, generally along the line V-V of FIG. 4.

With reference to FIGS. 4 and 5, enhanced details of construction of the water reservoir 53, evaporator 46 and the ice maker that comprises the metal inner cylindrical wall 67 of the evaporator, as well as the details of construction of the auger 60 with its generally helical flight are shown, whereby water W in the water reservoir 53 can enter into the ice making zone 66 of the evaporator, from the right end thereof, as shown by the arrow 65, allowing the rotating auger 60 to scrape ice being formed inside the cold cylindrical wall 67 of the evaporator, with the auger 60 moving the ice from right to left in the illustration of FIG. 4, into zone 68, wherein it is compacted and moved upwardly via the ice nugget delivery conduit 71, to the bin 73.

The water reservoir 53 and the outer wall 52 of the evaporator are constructed of a non-metallic material, preferably a thermoset plastic, molded as a single unit, or in components that are then fused together, and are preferably fiber-reinforced, and of a preferably polyester material reinforced with glass and/or minerals, that is sufficiently dense and non-porous that it prevents the passage of gaseous refrigerant fluid through the thermoset plastic, most especially for that portion of the thermoset plastic that comprises the evaporator jacket. The material of the evaporator jacket, once molded, is dimensionally stable, allowing for essentially no dimensional creep. Such material resists the attachment of chemical cleaners thereto, and has good mechanical strength for pressure containment of the gaseous refrigerant for which it provides the outer jacket of the evaporator.

The gearmotor 62 drives the shaft 63 that, in turn, rotates the auger 60.

Figure 4A:
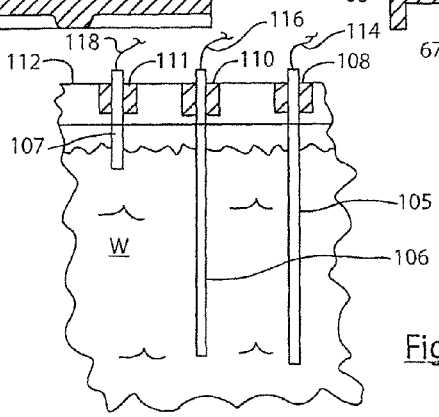
FIG. 4A is a fragmentally transverse sectional view of a portion of the water reservoir of FIG. 4, taken along the line of IV A-IV A of FIG. 4, and wherein conductivity rods are illustrated present in water in the water reservoir, for providing a control feature thereto.

With reference to FIG. 4A, it will be seen that conductivity rods or probes 105, 106 and 107 are carried by insulators 108, 110 and 111, respectively, which insulators are mounted in a top 112 of the water reservoir 53, which top 112 is secured to the reservoir 53 by means of an O-ring 113.

While the float 100 illustrated in FIG. 3 inside the water reservoir 53 controls the inflow of water to the water reservoir 53 via water supply line 97, the control rods illustrated in FIG. 4A with their electric connections 114, 116 and 118, respectively lend themselves to various other types of control. For example, the control rods can detect a high level of water in the reservoir 53, between the conductivity probe 107 and the common conductivity probe 106, when water reaches a predetermined height in the reservoir, for shutting down one or more components of the system, or, for example, for restarting the compressor 41, after a period of shutdown of the refrigeration cycle or for starting the ice making operation when the water level in the reservoir is above a predetermined level due to melt water from the ice storage bin entering the reservoir. Conversely, the electrical connection through the water W in the reservoir 53, that is made between the common conductivity probe 106, and the low water conductivity probe 105 may be used to shut down the compressor 41 via its electrical connection line 120 to a controller 121 associated with the compressor 41, or, alternatively such electrical connection between the probes 105 and 106 or between the probes 106 and 107 can control the operation of the gearmotor 62 that drives the auger 60, via electric line 85, or to control the delivery of ice from the conduit line 71 to the bin 73 by operating full ice bin controller 84 to discontinue ice delivery.

At the right end of the water reservoir 53, near the bottom thereof, there is a water discharge line 49, as illustrated in FIGS. 3 and 4, with the water discharge line 49 having a discharge valve 59 manually operable, for draining water from the system for cleaning and/or sanitizing the otherwise closed system, as will be discussed hereinafter.

Figure 6:
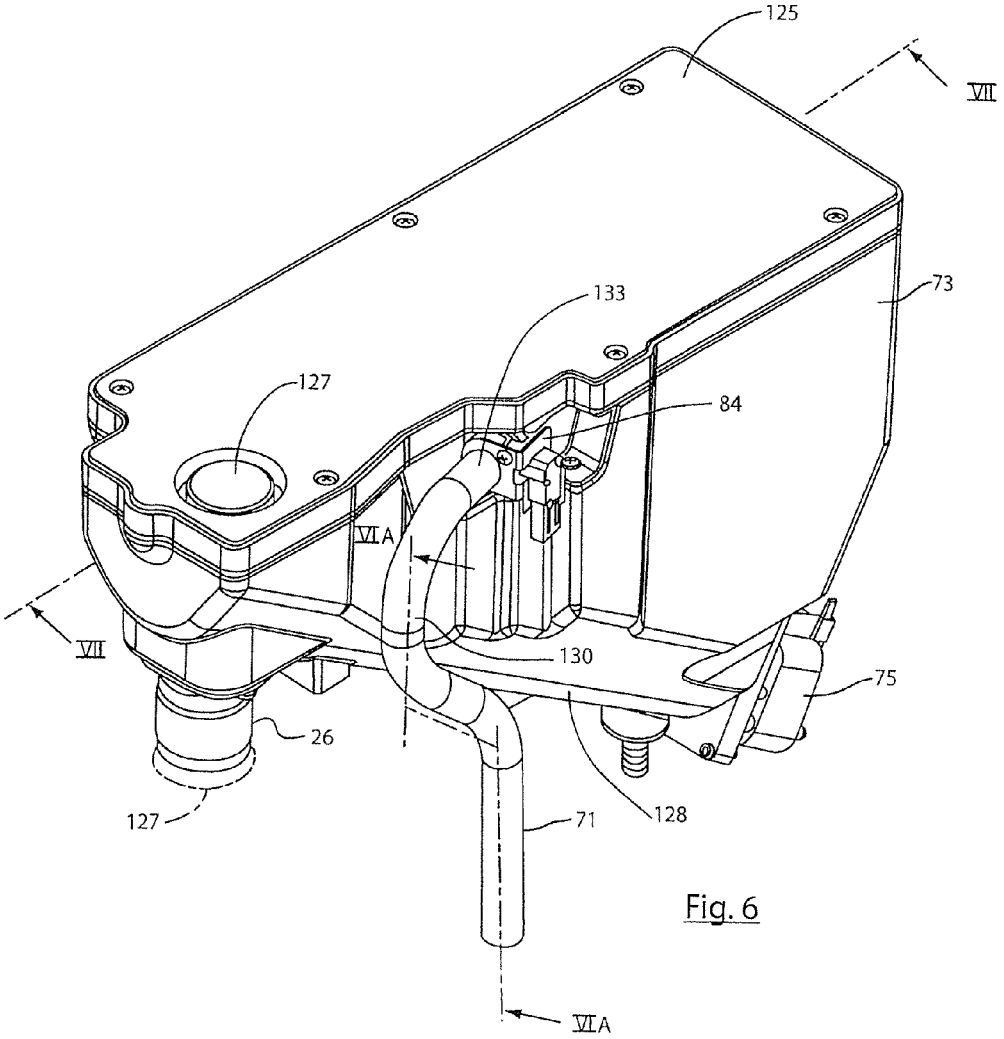
FIG. 6 is a perspective front, top and right side view of an ice storage bin in accordance with this invention.

With reference to FIG. 6, the ice bin 73 is illustrated as having a lid 125 sealing closed the upper end of the ice bin 73 by means of a gasket 126 or similar seal.

Also, in the lid 125 there is a removable access cap 127, that is normally sealingly closed therein, but which can be removed when the ice bin 73 is to receive a cleaning and/or sanitizing solution, as will hereinafter be described, and then that removable cap 127 can be inverted and used to seal close the ice nugget discharge outlet 26, as is shown in phantom at the lower left side of the illustration of FIG. 6.

Figure 7:
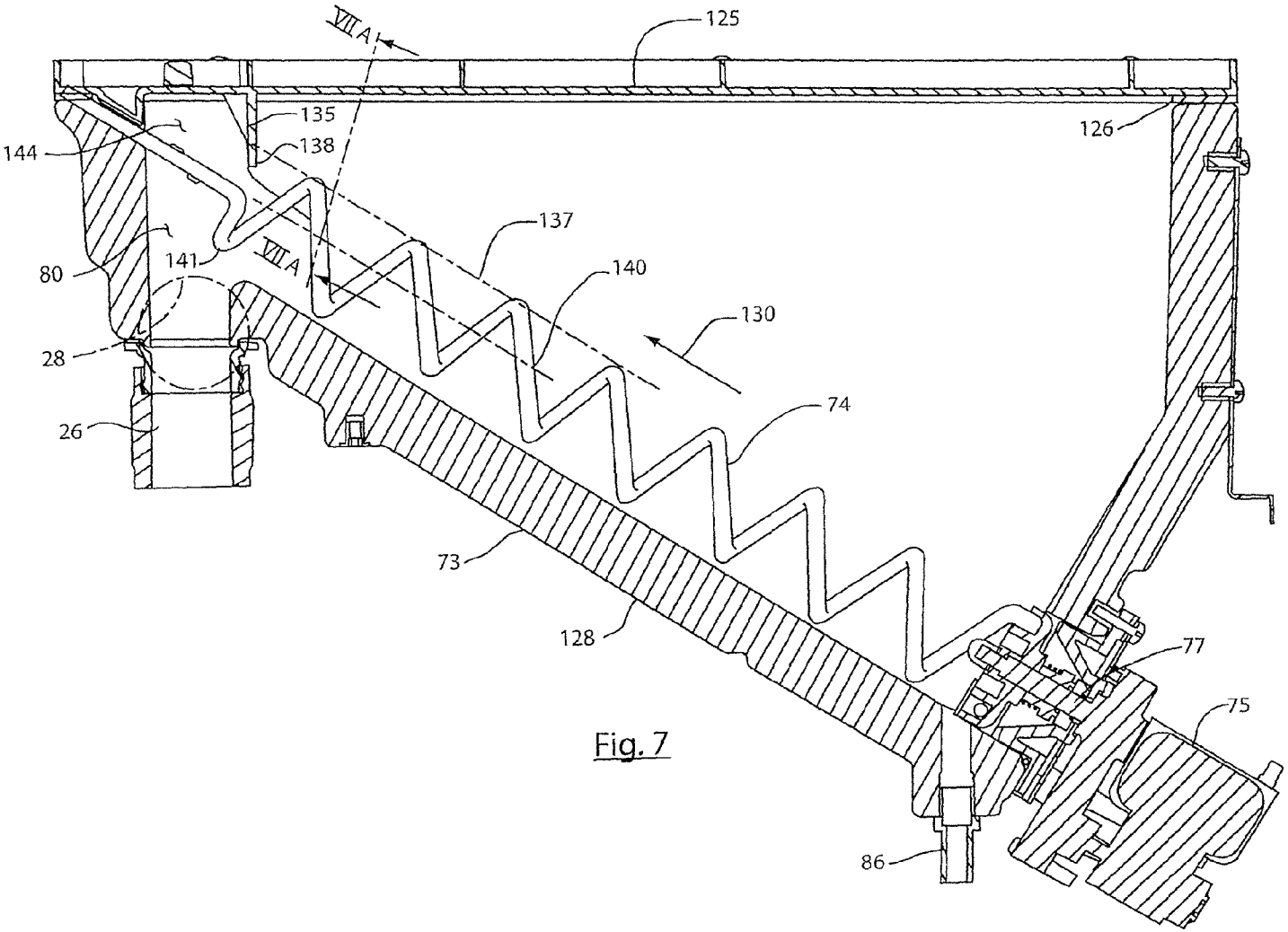
FIG. 7 is a vertical sectional view, taken through an ice storage bin in accordance with this invention, and wherein the auger for delivering ice nuggets from a lower end of the bin to an upper end of the bin, to engage a baffle at the upper end of the bin or to pass beneath the baffle out through the ice discharge outlet is made possible, by the location of the baffle.

As is illustrated in FIGS. 6 and 7, the ice storage bin 73 has a sloped bottom wall 128, inside which is present the wire auger 74, driven by means of the motor 75, via shaft 77, for conveying ice nuggets that are present in the bin 73, from a lower end of the bin, to an upper end of the bin, at the left upper side of the bin as is shown in FIG. 7. Nuggets are thus delivered, upwardly, in the direction of the arrow 130 shown in FIG. 7, to enter the zone 80 to pass into the nugget discharge outlet 26 when triggered by actuation of the nugget discharge actuator 28 (shown in phantom in FIG. 7).

Figure 6A:
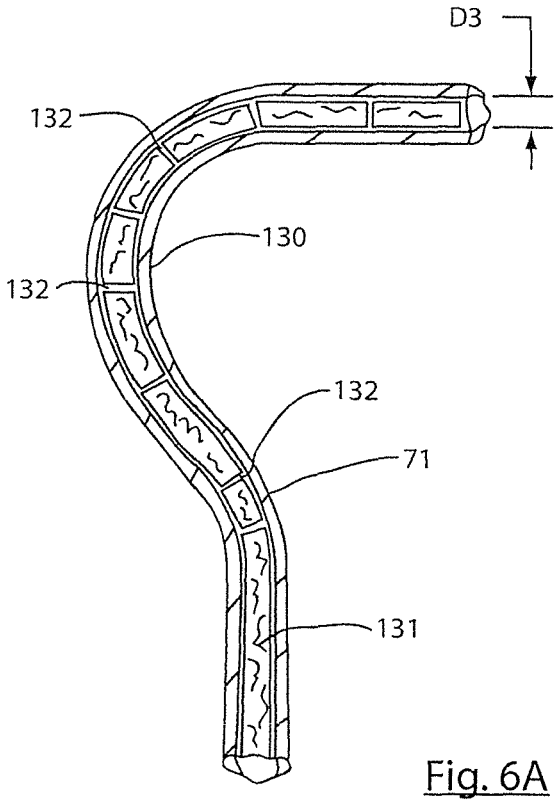
FIG. 6A is a fragmentally vertical sectional view, through the ice nugget delivery conduit that delivers ice nuggets to the bin, taken generally along the line VI A-VI A of FIG. 6, and wherein the arcuate configuration thereof serves to break up ice into ice nuggets of a desired size.

With reference to FIG. 6A, it will be seen that the ice nugget delivery conduit 71 has an arcuate bend 130 therein, whereby a column of compressed, flaked ice 131 is supplied thereto from the compression zone 68 therefor illustrated in FIG. 4, and that when the column 131 of ice traverses the arcuate bend 130 in the delivery line 71 the forcing of the column of ice 131 around the arcuate bend 130 causes it to break at various locations 132, into individual nuggets, which are delivered into the bin 73, through a side entry location 133 into the interior of the bin, through the control 84 described previously. Thus, it will be seen that the entry of nuggets into the bin 73 from a side location in the bin, near the top cover 125 thereof, precludes the entry of nuggets into the bin 73 from requiring additional bin height.

In FIG. 6A, it will be noted that the inside diameter of the conduit 71 has a diameter D3 as shown, that closely matches the diameter of the nuggets being produced, so that a simple, gentle bend 130 in the conduit causes the column 131 of compressed, flaked ice to become cracked to desirable lengths, as shown in FIG. 6A.

Figure 7A:
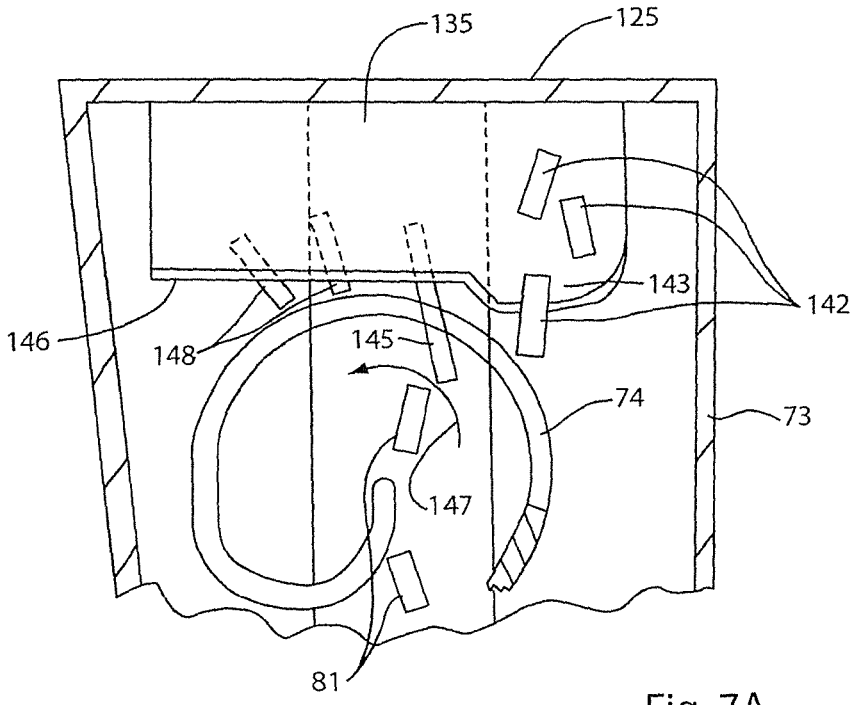
FIG. 7A is an enlarged fragmentary illustration of a portion of the ice storage bin of FIG. 7, taken generally along the line VII A-VII A of FIG. 7, wherein ice nuggets delivered by the auger into the area in which the baffle is located are illustrated.

With reference now to FIGS. 7 and 7A, it will be seen that near the upper end of the ice bin 73, there is provided a baffle 135 carried by the top or lid 125 of the bin 73, with the baffle 135 extending downwardly into the interior of the bin. The baffle 135 is thus generally vertical, and is disposed adjacent to, but not directly above the ice discharge spout or outlet 26.

In FIG. 7, there is shown as a phantom line, the theoretical outside diameter 137 of the auger, and it will be seen that the baffle protrudes into that diameter, toward a central axis 140 of the auger 74 that is at an acute angle to the horizontal of 30°. It will also be noted that the lower edge 138 of the baffle as shown in FIG. 7 does not interfere with rotation of the auger 74 and that the angle of the auger axis causes the helix of the auger to pass in front of, or to the left of the baffle 135 in its lowermost position of the auger 74, while still being above the discharge outlet 26.

With reference to FIG. 7A, it will be seen that ice nuggets 142 are blocked by the lower right face 143 of the baffle to block ice nuggets on the right side of the baffle as shown in FIG. 7A, metering the flow of ice to the discharge 26, in that, such ice nuggets 142 delivered to the right of the baffle as shown in FIG. 7 will tend to rise up on the face 143 of the baffle, to be recirculated and fall back toward the lower end of the bin, whereas ice nuggets 148 that pass below the baffle are able to enter the zone 80 above the outlet 26. This allows the flow rate of ice to remain fairly constant until the general ice level in the bin 73 drops well below the auger fill level, which is typically when the bin is about 75% empty.

Thus, it will be seen that the baffle blocks ice from entering the space 144 to the left of the baffle 135 as viewed in FIG. 7. This arrangement of and function of the baffle eliminates the necessity of making the ice outlet or spout 26 much larger in order to handle the desired volume, leaving the opening of the discharge outlet or spout 26 to be relatively small, that enables ice to be focused into the user's cup 82, rather than spilling out around the cup 82.

It will be noted that larger nuggets 145 of ice can engage the edge 146 of the baffle 135 as the nuggets 145 are being urged thereagainst by the upper end of the auger 74 rotating in a counter clockwise direction as shown by the arrow 147, such that such larger nuggets 145 will be sheared into smaller sized nuggets, to be of a desirable size at 148 to pass through the outlet or spout 26 upon discharge.

The present invention thus allows the wire type auger and baffle to cooperate to enable a continuous stream of ice to be delivered via the outlet or spout 26, without surges.

Figure 8A:
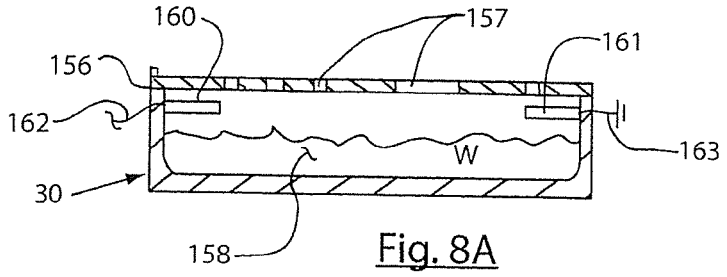
FIG. 8A is an unexploded transverse vertical sectional view, taken through the drain tray of FIG. 8, wherein conductivity strips are illustrated above the water level in the tray.
Figure 8:
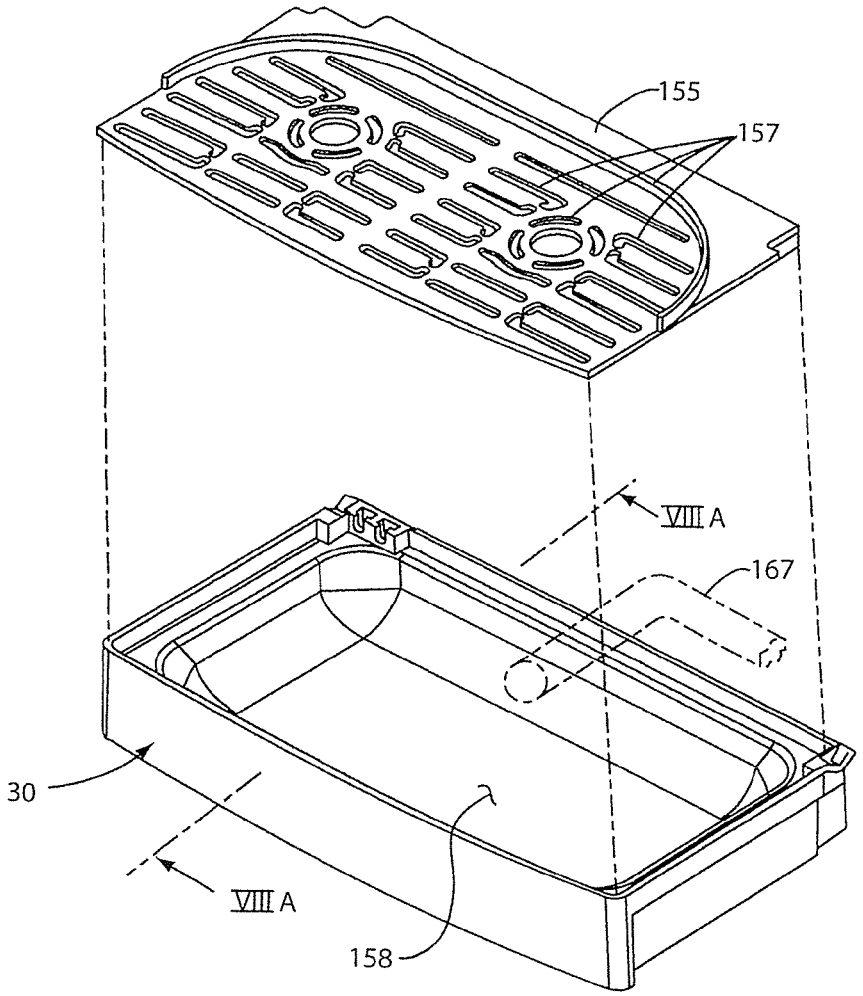
FIG. 8 is a top and front perspective exploded view of the drip tray in accordance with this invention, with a drain panel being shown above a drain water retention tray is illustrated, and with an optional drain line from the tray being shown in phantom.

With reference now to FIGS. 8 and 8A, the drain 30 is illustrated in greater detail, as including an upper grate 155 adapted to be carried at the upper end 156 of the tray 30.

The grate 155 is provided with a number of slots or other openings 157 therein to allow water that may overflow from a cup 96, or ice that may not fall into a cup 82 when water or ice are being dispensed, such that the water, or water from ice melt can pass through the openings 157 in the grate, and accumulate on the inside 158 of the tray 30.

Referring now to FIG. 8A, it will be seen that water W' accumulating on the inside 158 of the tray 30 may build up to a given level, at which it may contact conductivity rods or strips 161 carried at the upper end of the inside 158 of the tray 30, completing an electrical connection between the rods 160 and 161, such that electric wiring or the like 162, powered by an electric source 163, may cause the water outlet actuator 27 to close off the water discharge outlet 25. Optionally, as shown in FIG. 3, the electric line 162 may, via electric line 164, shown in phantom, shut down the motor 75 that drives the auger 74 inside the ice bin 73. Further, optionally, the electric line 162 may close the water inlet valve 91, via control line 165, shown in phantom.

Also, in the event that a leak should occur anywhere in the system, sensors located throughout the system will automatically close the water inlet valve 91.

Additionally, if desired, when the circuit for the conductivity rods 160, 161 is completed, such may activate a liquid crystal display or the like 166, shown in FIG. 2, via a suitable electric line (not shown), which display may light up with a legend such as "TRAY FULL".

While the tray illustrated in FIG. 8 is adapted to be used free of any water discharge line, such that it can periodically be manually emptied, a further option for the tray 30 exists in providing a discharge line 167 from the lower end of the tray, such as that shown in phantom in FIG. 8, which discharge line 167 can deliver water from the tray 30 to a drain or a collection container or the like, as may be desired.

The Cleaning/Sanitizing Operation

As has been mentioned above, the ice/water system of this invention is a closed system, to guard against bacteria or other undesirable components entering into the system.

When it is desired to clean the system, such will preferably be done when the level of water W in the water reservoir 53 is substantially empty. Then, the water control valve 91 and/or actuator 27 can be shut off, as will the water delivery from line 97 be shut off by closing the valve 98, and the valve 59 for emptying the water reservoir 53 via its discharge line 49 will be closed, after all the water is drained from the closed system.

Then, upon removal of the cap 127 at the top of the bin 73, the cleaning and/or sanitizing solution can be added to the bin 73, which will fill the bin, the drain line 86, the water reservoir 53, the ice making zone 66, and the ice conduit 71, all after the cap 127 has been removed from the top 125 of the bin 73, and re-located beneath the ice discharge outlet, as shown in phantom at 127 in FIG. 6. In this condition, the ice maker, water reservoir, ice storage bin, ice delivery conduit line and melt water drain line, normally sealed closed to atmosphere, can now received the solution and be cleaned and/or sanitized.

If desired, during the cleaning operation, the motor 62 may be used to drive the auger 60 inside the evaporator, and/or, the motor 75 may drive the auger 74 in the ice storage bin 73, to provide some agitation of the cleaning/sanitizing solution within the system.

After a pre-determined cleaning time, the valve 59 in the discharge line 49 from the water reservoir 53 can be opened, and the cleaning solution can be discharged into a drain or container, as may be desired.

Thereafter, the cap 127 can be removed from its position closing off the ice discharge outlet 26, and returned to close the opening in the top 125 of the bin cover, and various water inlets to the system can be resumed, once the sanitizing cleaning solution and/or any desired rinsing of the system has been completed, with the valve 59 thereafter being closed, and operation of the ice and water dispensing system can resume.

It will thus be seen that the present invention allows for cleaning and/or sanitizing the system, without requiring disassembly of the various components of the system and without requiring manual cleaning of the various components of the system.

It will be apparent from the foregoing that various modifications may be made in the details of construction, as well as in the use and operation of the various components of this invention, all within the spirit and scope of the invention as defined in the appended claims.

What is claimed is:

1. A low profile combination ice maker and ice and water dispenser device for home and/or office use that comprises a self-contained unit, including:

(a) a structure of no more than 18 inches in height comprising said device, for disposition in a vertical opening on top of a countertop and beneath an overhanging cabinet and including a front, rear, left and right sides and a top and a bottom;

(b) said device having a water inlet for connecting to a source of inlet water and a water conduit line therein, and an electrical connection to a source of electric current for operating motors and/or switches within said device;

(c) said device including a water discharge outlet at the front of the device spaced adjacent one of the left and right sides of the device, connected to the water conduit line, a water discharge valve for opening the water discharge outlet and a water discharge actuator for actuating the water discharge valve to dispense water into a vessel disposed beneath the water discharge outlet;

(d) said device including an ice nugget discharge outlet at the front of the device separate from the water discharge outlet and spaced adjacent the other one of said left and right sides of the device, and an ice discharge actuator for actuating the dispensing ice nuggets into a vessel disposed beneath the ice discharge outlet;

(e) a tray disposed beneath the water discharge outlet and beneath the ice nugget discharge outlet;

(f) the tray comprising container for holding excess water from the water discharge outlet and/or the ice discharge outlet and a perforate grate in the container at an upper end thereof on which the vessels can be situate for receiving ice or water therein;

(g) refrigeration system inside said device at a lower end thereof for making ice nuggets from water delivered thereto via said water conduit line;

(h) a delivery conduit for delivering ice nuggets from the refrigeration system at the lower end of the device in a vertically upward direction into an ice nuggets storage bin;

(i) the ice nugget storage bin located inside said device located a higher end of the device for storing ice nuggets received via said delivery conduit means;

(j) an ice conveyor within said ice nugget storage bin for conveying ice nuggets in a vertically upward direction in said bin for gravity discharge of ice nuggets from the bin via the ice nugget discharge outlet; with the ice nugget discharge outlet being located at an upper end of the bin, for discharge of ice into a vessel disposed on the tray beneath the ice nugget discharge outlet; and (k) the ice conveyor within said ice nugget storage bin comprises a rotatable auger having lower and upper ends and disposed in the storage bin for rotating about a central auger axis and conveying ice in a path of travel from a lower end of the bin and an upper end of the bin at an angle, toward the ice nugget discharge outlet at the upper end of the bin.

2. The dispenser device of claim 1, wherein the refrigeration system includes a compressor, condenser, expansion device and evaporator for a refrigerant fluid, for cooling a cylindrical freezing chamber and a rotatable auger within said freezing chamber for scraping ice off an interior wall of the freezing chamber and compressing the ice into an elongate ice nugget.

3. The dispenser device of claim 1, wherein the delivery conduit includes an arcuate delivery portion of said conduit, having an arcuate radius sufficient for breaking up an elongate ice nugget into a plurality of ice nuggets for delivery into said bin.

4. The dispenser device of claim 3, wherein the delivery conduit for delivering ice nuggets to the ice storage bin delivers ice nuggets into the bin via the arcuate delivery portion of the conduit at an entry point that is on a side of the bin, adjacent to the top of the bin, and comprises an ice fill controller for facilitating a maximum fill of ice nuggets into the bin, and wherein the space above the top of the bin is free of any ice delivery conduit.

5. The dispenser device of claim 1, including a water reservoir for receiving water via said water conduit line and supplying water to said refrigeration system for making ice nuggets.

6. The dispenser device of claim 5, including a valve and a float for controlling the water level in said water reservoir.

7. The dispenser device of claim 5, including a melt water delivery line between said ice nugget storage bin and said water reservoir, comprising gravity operated flow of melt water from melted nuggets in said bin, back to said water reservoir.

8. The dispenser device of claim 1, wherein the refrigeration system is of a capacity that produces greater than four pounds of ice per hour.

9. The dispenser device of claim 1, wherein the ice nugget storage bin has a capacity for storing greater than seven pounds of ice in the bin.

10. The dispenser device of claim 1, wherein the tray includes conductivity rods or strips for discontinuing the discharge of water from the water discharge outlet and of ice from the ice nugget discharge outlet when water in the tray reaches a pre-determined level.

11. The dispenser device of claim 1, wherein the tray is free of any water outlet.

12. The dispenser device of claim 1, wherein the tray has a water outlet.

* * * * *